US006354217B1

(12) United States Patent
Narumi et al.

(10) Patent No.: US 6,354,217 B1
(45) Date of Patent: Mar. 12, 2002

(54) ELECTRIC IGNITION TYPE INITIATOR

(75) Inventors: Kazuhito Narumi; Fukumi Kaida, both of Ibaraki-ken (JP)

(73) Assignee: Showa Kinzoku Kogyo Co., Ltd., Nishiibaraki-gun (JP)

( * ) Notice: Subject to any disclaimer, the term of this patent is extended or adjusted under 35 U.S.C. 154(b) by 0 days.

(21) Appl. No.: 09/689,873

(22) Filed: Oct. 13, 2000

(30) Foreign Application Priority Data

Oct. 14, 1999 (JP) ..... 11-292127

(51) Int. Cl.[7] ..... F42B 3/12
(52) U.S. Cl. ..... 102/202.7; 102/202.5
(58) Field of Search ..... 102/202, 202.7, 102/202.9, 202.8, 202.5

(56) References Cited

U.S. PATENT DOCUMENTS 3,264,990 A * 8/1966 Betts ..... 102/202.7
3,462,633 A * 8/1969 McCoy ..... 102/202.7
3,974,424 A * 8/1976 Lee ..... 102/202.5
4,729,315 A * 3/1988 Proffit et al. ..... 102/202.5
4,976,200 A * 12/1990 Benson et al. ..... 102/202.9
5,736,668 A * 4/1998 Fogle, Jr. et al. ..... 102/202.7
5,831,203 A * 11/1998 Ewick ..... 102/202.5
6,133,146 A * 10/2000 Martinez-Tovar et al. .. 102/202.4
6,199,484 B1 * 3/2001 Martinez-Tovar et al. .. 102/202.5
6,234,081 B1 * 5/2001 Neyer ..... 102/202.7
6,272,965 B1 * 8/2001 Baginski et al. ..... 102/202.7

FOREIGN PATENT DOCUMENTS

FR 1183195 * 7/1959 ..... 102/202.5

* cited by examiner

*Primary Examiner*—Michael J. Carone
*Assistant Examiner*—Lulit Semunegus
(74) *Attorney, Agent, or Firm*—Oblon, Spivak, McClelland, Maier & Neustadt, P.C.

(57) ABSTRACT

An electric ignition type initiator applies an electrical signal via a pair of electrical signal input portions to a resistance element connected across the electrical signal input portions to heat the resistance element to cause the heat from the resistance element to ignite an explosive charge and thereby operate a vehicle safety apparatus. The resistance element is formed by etching a film of nickel-chrome alloy provided on the top surface of a substrate. The first side of the resistance element extends in a straight line between the electrical signal input portions, and the second side is inclined from each of the electrical signal input portions so that the width between the first side and each incline on the second side decreases as distance from the respective electrical signal input portion increases. The resistance element has its minimum sectional area where the inclines meet.

5 Claims, 3 Drawing Sheets

ELECTRIC IGNITION TYPE INITIATOR

BACKGROUND OF THE INVENTION

1. Field of the Invention

The present invention relates to an improvement to an electric ignition type initiator devised to heat a resistance element connected between a pair of electrical signal input sections, based on electrical signals applied through the electrical signal input sections, to effect combustion of an explosive powder charge by the heat generated by the resistance element. The invention particularly relates to an electric ignition type initiator used as the igniter in a gas generation apparatus used to instantaneously operate a vehicle safety device such as a seatbelt or airbag.

2. Description of the Prior Art

An automotive safety device such as a seatbelt is provided with rapid retraction means that in the event of a collision or the like functions to instantaneously retract the belt to protect the user. Similarly, an airbag is equipped with rapid deployment inflation means that, in the event of a collision or the like, instantaneously inflates the bag with gas to protect the user by absorbing the shock of the collision.

Seatbelt rapid retraction means and airbag rapid inflation means generally use gas generators that generate gas by igniting a gas generating agent. In the event of a crash, the gas generation agent is ignited by a mechanical igniter triggered by the crash impact, or by an electrical igniter triggered by an electrical signal. The pressure of the burning gases thus produced is utilized to rapidly retract a seatbelt and instantaneously inflate an airbag.

FIG. 6 shows a prior art electric ignition type initiator used as the initiator in such gas generation devices. As shown, the ends of two current conduction pins 1 are connected by a resistance element 2, which is covered by a priming charge 3. The pins 1 are affixed by a glass hermetic or resin plug 4. The peripheral portion of the plug 4 has a metal casing 5 that encloses the resistance element 2 and charge 3. Inside, the space is filled with an ignition charge 6.

The element 2 may be metal, or metal alloy wire, or metal formed in a prescribed shape by etching, or a thin film of metal alloy. When a vehicle having this electric ignition type initiator is involved in a crash or the like, a shock sensor detects the impact and outputs a signal that is supplied to the resistance element via the pins 1, generating Joule heat that heats up the element 2. When the element 2 heats up to a prescribed temperature, the priming charge 3 ignites, setting off the ignition charge 6 and igniting the gas generation agent. The gas thus generated is instantaneously delivered to a seatbelt to effect rapid retraction of the seatbelt, or is used to effect instantaneous inflation of an airbag. The shorter the time between shock sensor detection of the collision impact and activation of the seatbelt or airbag, the more securely the user is protected. At the very least, this requires a system response time in the order of milliseconds. Therefore, with respect to the gas generation apparatus used to operate seatbelt retraction or airbag deployment, the electric ignition initiator needs to have a response time in the order of 1/10 millisecond.

Moreover, these days when vehicles use both seatbelts and airbags, it is also desirable to have a seatbelt activated before an airbag. Thus, it is also important for an initiator to function with good operating response characteristics in order to achieve precise control of these devices. In the case of an electric ignition type initiator in which the priming charge ignites when the initiator element is heated to a prescribed temperature, the time it takes for the element to reach that temperature has a major bearing on the initiator response characteristics.

In the case of the above prior art electric ignition type initiator, whether the resistance element is a wire or a film, the resistance is uniform along the whole length of the element, and the rise in temperature effected by the electrical signal input is also uniform along the whole length. That means that before the priming charge can be ignited, enough time is required for the whole length of the resistance element to reach the ignition temperature, which is disadvantageous in terms of device response characteristics. Moreover, the amount of heat radiation given off along the length of the element also has a considerable effect on the response characteristics. Also, environmental concerns make it difficult to use explosives that contain lead, such as lead trinitroresorcinate, which is heat-sensitive. This is forcing the use of explosives which have low sensitivity to heat, leading to a further increase in response time.

Related standards stipulate the resistance of the resistance elements used in gas generation systems employed in vehicle safety devices. Thus, it is not possible to increase the heating value by increasing the overall resistance of the element, since this would not comply with the standards. Even if the resistance value were to be increased, it would not improve the response as much as might be thought, since the element would be radiating more heat, as described above.

In light of these circumstances, an object of the present invention is to provide an electric ignition type initiator having good response to an electrical signal input.

SUMMARY OF THE INVENTION

To attain the above object, the present invention provides an electric ignition type initiator that applies an electrical signal via a pair of electrical signal input portions to a resistance element connected across the electrical signal input portions to heat the resistance element to cause the heat from the resistance element to ignite an explosive charge and thereby operate a vehicle safety apparatus, wherein the resistance element is formed by etching a film of nickel-chrome alloy provided on a top surface of a substrate, a first side of the resistance element extends in a straight line between the electrical signal input portions, and a second side is inclined from each of the electrical signal input portions so that a width between the first side and each incline on the second side decreases as distance from a respective electrical signal input portion increases, the resistance element having its minimum sectional area where the inclines meet.

When the element is configured so that a pair of conductive portions provided on the top surface of the substrate are connected across the electrical input portions, conductive portions that are each formed of a metal that is a good conductor, such as gold, for example, will be advantageous with respect to facilitating the task of soldering the connections. Forming the element by affixing a film of nickel-chrome to the top surface of the substrate enables volume production to be effected. It also makes it unnecessary to take the heat resistance of the substrate into consideration, so a cheaper material such as a composite plastic can be used, enabling manufacturing costs to be reduced. It is preferable to use a compound of zirconium and an oxidizing agent (potassium perchlorate, for example) as the explosive charge.

Further features of the invention, its nature and various advantages will be more apparent from the accompanying drawings and following detailed description of the invention.

DESCRIPTION OF THE PREFERRED EMBODIMENT

Figure 1:
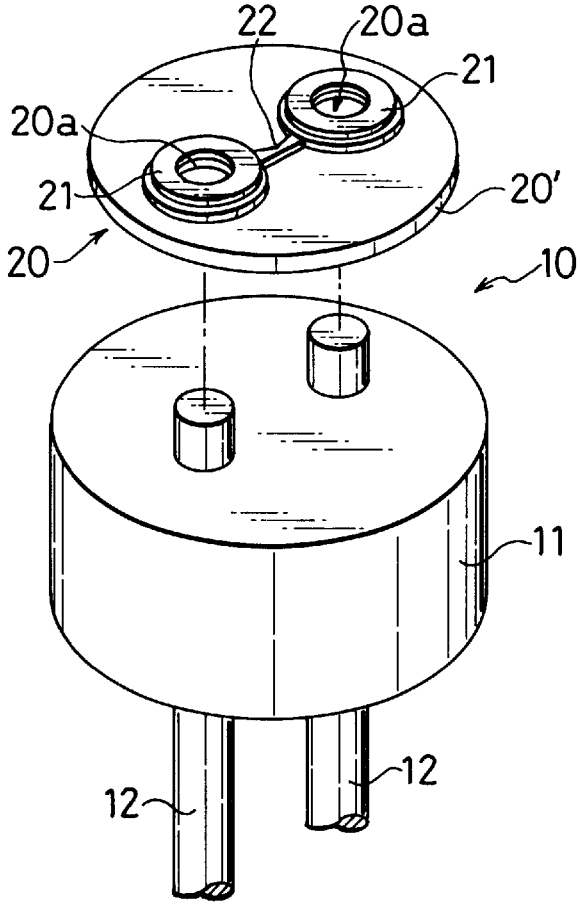
FIG. 1 is a perspective view of the important part of a electric ignition type initiator according to the present invention.

Details of an embodiment of the invention will now be described with reference to the drawings. FIGS. 1 to 4 show an embodiment of an electric ignition type initiator according to this invention. The initiator 10 is used as the igniter of the gas generation apparatus used in vehicle safety devices such as seatbelts and airbags, and includes a glass hermetic 11 to provide a seal. The glass hermetic 11 is cylindrical and holds a pair of current conduction pins 12 that pass through the glass hermetic 11 in alignment with the center axis thereof. The top surface of the glass hermetic 11 is provided with a heating resistance substrate 20. The heating resistance substrate 20 is formed of a composite plastic, specifically glass epoxy, has through-holes 20*a* located at positions corresponding to the current conduction pins 12 and is located on the top surface of the glass hermetic 11 with the current conduction pins 12 through the through-holes 20*a*. The heating resistance substrate 20 is provided with a pair of electrically conduction areas 21 that constitute conductive portions on the top surface of the heating resistance substrate 20. A resistance element 22 is provided between the conduction areas 21.

Figure 2:
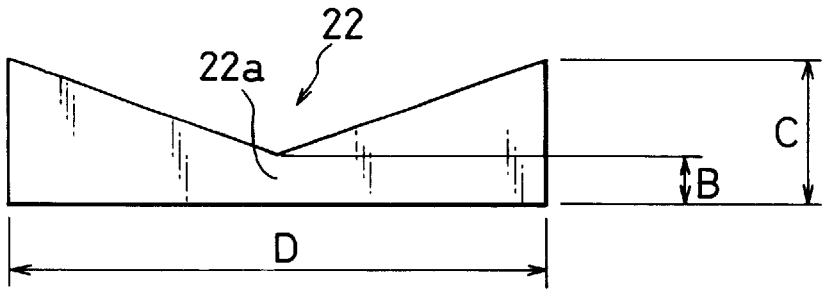
FIG. 2 is an enlarged plan view of the resistance element in the initiator of FIG. 1.
Figure 3:
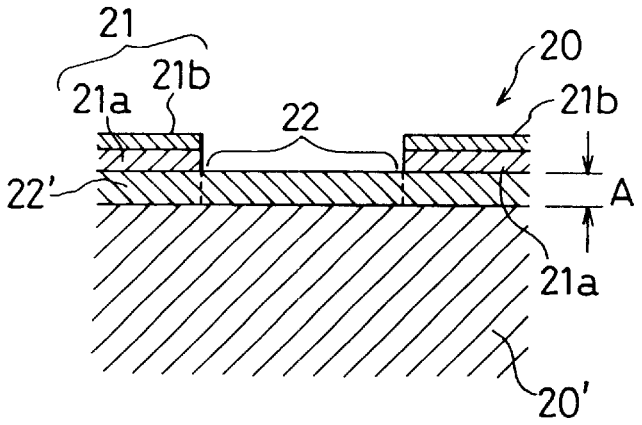
FIG. 3 is an enlarged cross-sectional view of the substrate used to form the resistance element.
Figure 4:
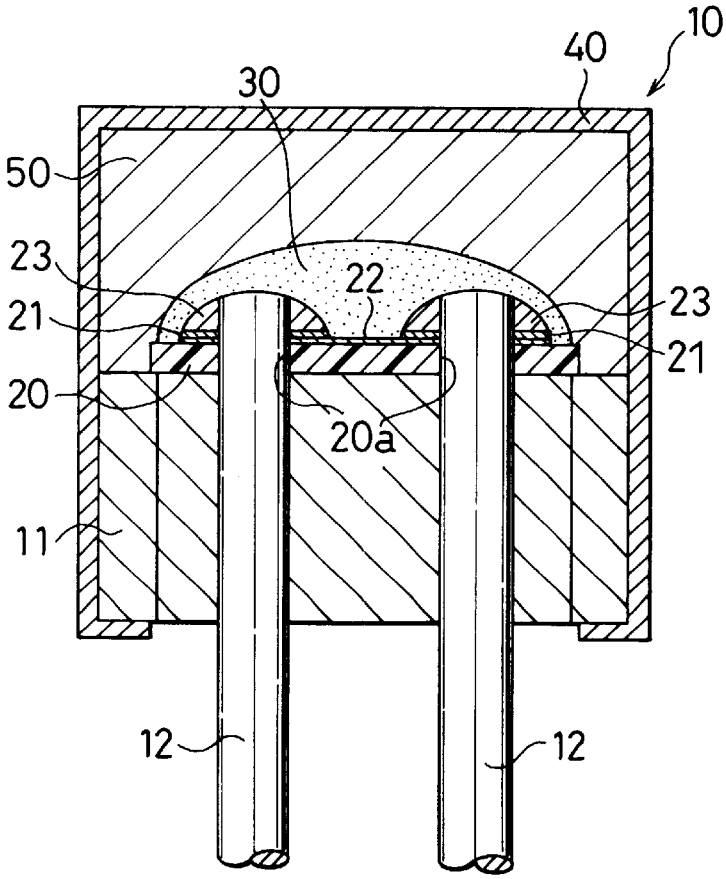
FIG. 4 is a cross-sectional view of the electric ignition type initiator of the present invention.

The conduction areas 21 are good annular conductors provided around each of the through-holes 20*a*. The conduction areas 21 are each individually connected to the current conduction pins 12 by a conductive connector 23 such as solder or a conductive bonding agent. The resistance element 22 connecting the conduction areas 21 has a constant thickness A, while the width decreases going towards the center portion 22*a*. That is, it is a high-resistance film resistor of length D having a gradually decreasing sectional area. Thus, as shown in FIG. 2, the resistance element 22 is formed with one straight side and the other side sloping in to the center portion, so that with respect to the width C at each end of the resistance element 22, the center portion 22*a* width B (<C).

The above heating resistance substrate 20 is formed as follows. A film 22' of nickel-chrome alloy is affixed onto the top surface of a composite plastic 20' formed into the required shape. The film can be affixed by using thermal crimping or adhesive. Photolithography is then used to etch the alloy film 22' to form a thin film 22' with a resistance element 22 having the above shape. To ensure compliance with the resistance value (2±0.2 ohms) and operating current characteristics stipulated by standards covering initiators for automotive applications, the resistance element 22 is formed so that width A is 0.005 mm, minimum width B is 0.05 mm, maximum width C is 0.1 mm and length D is 0.5 mm. Although these dimensions of the resistance element 22 have to be adjusted depending on the required resistance and operating current, they should be kept with the following ranges. Thickness A: about 0.002 to 0.01 mm; minimum width B: about 0.04 to 0.14 mm; maximum width C: 0.08 to 0.5 mm; length D: 0.3 to 2.0 mm.

Finally, the parts of the top surface of the composite plastic 20' other than where the conduction areas 21 are located are masked, and a layer of nickel 21*a* is applied, followed by a layer of gold 21*b*, resulting in a heating resistance substrate 20 on which the conduction areas 21 constituted by the nickel 21*a* and gold 21*b* are connected by the resistance element 22. The priming charge 30 is placed around and over the resistance element 22, and a metal casing 40 is fitted over the resistance element 22 and priming charge 30. The priming charge 30 is a compound having zirconium and an oxidizer as the main components that is applied to the heating resistance substrate 20 and then dried. The casing 40 is filled with an ignition charge 50 in powder form containing boron as the main component. The ignition charge 50 covers the priming charge 30 and is sealed in place by the glass hermetic 11.

The case 40 is fitted into an outer casing packed with a gas generating agent, for example, and the initiator 10 is installed in a vehicle with an electric signal output line connected to the current conduction pins 12. If the vehicle is in a crash, the impact causes the shock sensor to output a signal to the electric ignition type initiator 10 of the gas generation apparatus, heating up the resistance element 22 between the current conduction pins 12. When the resistance element 22 heats up to a prescribed temperature, the priming charge 30 in contact with the element ignites, igniting the ignition charge 50 and then the gas generation agent. The gas thus generated is used to instantaneously operate the seatbelt retractor and airbag deployment inflator means.

Since the resistance element 22 used in the initiator 10 has a center portion 22*a* with a smaller cross-sectional area, although the overall resistance of the resistance element 22 is a standard-compliant 2±0.2 ohms, the center portion 22*a* has a much higher resistance. Therefore, when current flows through the resistance element 22 via the current conduction pins 12, the heat that is generated is concentrated in the center portion 22*a*, so the amount of heat that is radiated is very small, enabling the resistance element 22 to be rapidly heated to the required temperature. The result is that the time from the input of the electrical signal to the ignition of the priming charge 30 is decreased, improving the operating response of the seatbelt retraction means and airbag inflation means, thereby facilitating control to effect seatbelt operation before the airbag deployment operation.

Results of performance tests on the electric ignition type initiator of this invention are shown below.

Inventive initiator used a nickel-chrome alloy element having a thickness A of 0.005 mm, a minimum width B of 0.05 mm, a maximum width C of 0.1 mm and a length D of 0.5 mm. For comparison, also listed are the results of performance tests on a prior art LED type initiator that uses a strip element having a uniform width of 0.1 mm.

Table 1 shows the initial states of the above initiators.

TABLE 1

| | Inventive initiator | Prior art initiator |
|---|---|---|
| Resistance between pins | 2 ± 0.2 Ω | 2 ± 0.2 Ω |
| Minimum ignition current 99.9999% −40° C. 2 ms pulses | 0.8 A | 1.3 A |
| Maximum non-ignition current 99.9999% 85° C. 10 ms pulses | 0.2 A | 0.2 A |
| Operating time (−40° C.) 2A 2 ms pulses | 0.2 ms | 0.4 ms |
| Time to maximum pressure (−40° C.) | 0.4 ms | 0.8 ms |

The inventive and comparative initiators were subjected to the following four environment tests.

Drop test:

The initiators were dropped five times at each of four attitudes in succession onto a concrete surface from a height of 1.5 m Thermal shock test:

1000 cycles at −30° C. and 80° C.

Sweep test:

Using a 5-minute log sweep at 10 to 25 Hz: 24 hours vertically at 4 G, 24 hours horizontally at 2.6 G, 24 hours to-and-fro at 1.6 G High temperature, high humidity continuity test:

80° C., 95% RH, 50 mA, 1000 hours

Table 2 shows the results obtained with respect to operating time and time to maximum pressure, using 2-ms, 2-amp current pulses.

TABLE 2

| | | Inventive initiator | Prior art initiator |
|---|---|---|---|
| Resistance between pins | | 2 ± 0.2 Ω | 2 ± 0.2 Ω |
| Operating time (−40° C.) 2A, 2 ms pulses | Average | 0.2 ms | 0.4 ms |
| | Standard deviation | 10 μs | 25 μs |
| Time to maximum pressure (−40° C.) 2A, 2 ms pulses | Average | 0.4 ms | 0.8 ms |
| | Standard deviation | 20 μs | 60 μs |

The above tables reveal that the inventive electric ignition type initiator had about the same current-ignition characteristics as the prior art initiator, but, as shown by Table 2, although the current was the same, the operating time of the inventive initiator was about half that of the prior art initiator, meaning the inventive initiator was clearly superior in terms of response characteristics. With respect to the environment tests, the initiators showed no change in performance, and no difference in average operating values was observed.

Moreover, in accordance with the above-described electric ignition type initiator the resistance element is constituted as a foil element formed by etching a thin film of nickel-chrome alloy provided on the substrate, which is better in terms of volume production capability and connection reliability than a configuration in which metal wires are individually connected to the electrical signal input sections.

Figure 5:
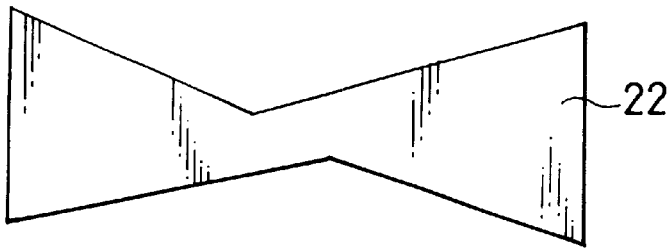
FIG. 5 is an enlarged plan view of a resistance element provided at the opposite sides thereof with sloped portions.
Figure 6:
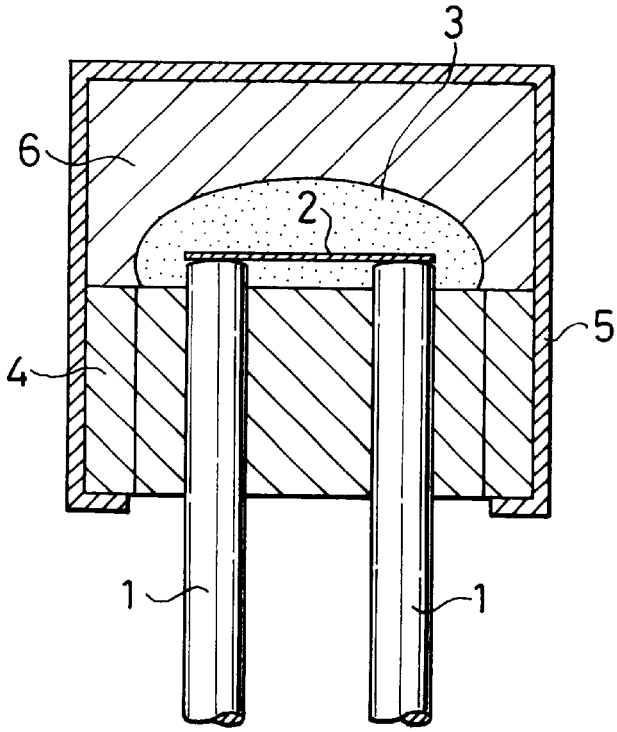
FIG.6 PRIOR ART
FIG. 6 is a cross-sectional view of a prior art electric ignition type initiator.

It is conceivable that as shown in FIG. 5 the opposite sides of a resistance element 22 are inclined so that the width of the resistance element is gradually reduced in the direction apart from an electrical signal input section to form a smallest-width meeting part in the vicinity of the center portion.

However, nickel-chrome alloy exhibits a lower processing precision than copper or aluminum. For this reason, in a resistance element of nickel-chrome alloy provided at the opposite sides thereof with sloped parts that are formed by etching, its minimum sectional area has an error of ±10% at the maximum. This will bring about a fatal problem that the time from the input of an electrical signal to the combustion of an explosive powder, i.e. the time up to when an automotive safety device including rapid retraction means for a seatbelt and rapid deployment inflation means for an airbag operates, varies widely.

Since a gas generator equipped with a resistance element having a resistance value made small by such dispersion becomes slow in responsibility to an electrical signal and large in ignition-waiting time, seatbelt retraction is delayed. This possibly causes the user to move forward and collide powerfully against an airbag to greatly hurt the user. Since resistance elements having a low resistance value are eliminated in sorting of resistance values, this lowers the rate of good products and is not desirable from the industrial point of view. Therefore, it is important for a gas generator used particularly in a pretensioner for a seatbelt to make its responsibility to an electrical signal rapid sharply and reduce its dispersion in ignition-waiting time as much as possible.

As described above, however, the resistance element 22 of the invention is formed with one straight side and the other side sloping to the center portion. That is to say, since the minimum sectional area of the resistance element is constituted by providing only the other side with sloped portions, the dimensional error of the minimum sectional area is at least one half the error of the resistance element shown in FIG. 5. This is advantageous in terms of the dimensional accuracy. Therefore, the time up to when an automotive safety device operates does not so greatly vary, thereby enabling the operational responsibility to be enhanced.

Table 3 shows the pressure generation initiation time (ignition-waiting time), in terms of the average value, standard deviation and maximum value, of 10 gas generators using the initiator with the resistance element, 10 gas generators using the conventional resistance element and 10 gas generators using the resistance element with the sloped portions at the opposite sides. In Table 3, the resistance value of each element nearly equals 2 Ω.

TABLE 3

| Pressure generation initiation time | Average value | Standard deviation | Maximum value |
|---|---|---|---|
| Gas generator using inventive resistance element | 1.2 ms | 0.15 ms | 1.7 ms |
| Gas generator using conventional resistance element | 1.8 ms | 0.10 ms | 2.2 ms |
| Gas generator using resistance element with sloped portions at opposite sides | 1.2 ms | 0.30 ms | 2.4 ms |

General Standard (in the case of a gas generator) of pressure generation igitiation time (ignition-waiting time)= (average value+3σ)<2.0 ms, wherein σ denotes standard deviation.

As is clear from Table 3 above, the average value of the pressure generation initiation times of the 10 gas generators using the resistance element of the invention is 1.2 ms, the maximum value thereof is 1.7 ms and the standard deviation thereof is 0.15. The total of the average value (1.2 ms) and the three-fold standard deviation (0.15 ms×3=0.45) in the inventive resistance element is 1.65 ms that is smaller than 2 ms, thus meeting the general standard. On the other hand, the total thereof in the resistance element with the sloped portions at the opposite sides is 1.2 ms+0.30 ms×3=2.10 ms that is larger than 2 ms, thus not meeting the general standard. In the resistance element with the sloped portions at the opposite sides, there is a fair possibility of a positional deviation occurring between the bottoms of the sloped portions at the opposite sides as shown in FIG. 5. This makes it difficult to form resistance element having a prescribed minimum width to give rise to dispersion in responsibility to a current.

Although in the above embodiment the resistance element is formed with one straight side and the other side sloping to the center portion so that the minimum sectional area portion thereof is provided at the center part of the element, this is not limitative. As long as the minimum sectional area is in contact with the priming charge, it can be provided anywhere and will provide the same effect.

Also, since in accordance with the above embodiment the film can be provided on the substrate by using thermal crimping or adhesive, it is not necessary to take the heat-resistance qualities of the substrate into consideration, so costs can be reduced by using low-cost materials such as composite plastics. However, it is also possible to form the substrate of a material such as ceramics having high heat-resistance.

When a conductive portion of the resistance element is used to provide a connection across the electrical signal input sections, using gold for the conductive portion is advantageous in terms of oxidation resistance and solder wettability characteristics, and therefore enables productivity to be improved. However, a metal or alloy having a low volume resistivity can also be used.

In the foregoing the invention has been described with reference to the use of a priming charge that is a compound having zirconium and an oxidizer as the main components, but it is also possible to use a detonator material such as lead trinitroresorcinate. Moreover, while the above embodiment uses an ignition charge containing boron as the main component, other explosives may be used, including compounds having titanium and an oxidizer as the main components.

As described in the foregoing, the present invention provides an electric ignition type initiator in which the resistance element is formed by etching a film of nickel-chrome alloy provided on a top surface of a substrate, one side of the resistance element extends in a straight line between the electrical signal input portions, and the other side is angled in from each of the electrical signal input portions so that a width between the first side and each incline on the second side decreases as distance from a respective electrical signal input portion increases, the resistance element having its minimum sectional area where the angled portions meet. This configuration results in a shorter operating response time than prior art arrangements. It also enables vehicle safety devices such as seatbelts and airbags to be controlled for effective and instantaneous deployment.

Moreover, the resistance element is formed by etching a layer of nickel-chrome alloy provided on the substrate, which is advantageous in terms of productivity and connection reliability. Volume production can be enabled by bonding the nickel-chrome film to the substrate, and it also means that the heat-resistance of the substrate does not have to be taken into consideration, making it possible to use a cheaper material for the substrate, such as a composite plastic, enabling manufacturing costs to be reduced.

What is claimed is:

1. An electric ignition type initiator that applies an electrical signal via a pair of electrical signal input portions to a resistance element connected across the electrical signal input portions to heat the resistance element to cause heat from the resistance element to ignite an explosive charge and thereby operate a vehicle safety apparatus, wherein:

said resistance element is formed by etching a film of nickel-chrome alloy provided on a top surface of a substrate, a first side of said resistance element extends in a straight line between the electrical signal input portions, and a second side is inclined from each of the electrical signal input portions to form two inclines so that a width between the first side and each incline on the second side decreases as distance from a respective electrical signal input portion increases, the resistance element having its minimum sectional area where said inclines meet.

2. An initiator according to claim 1, wherein the resistance element is connected between the pair of electrical signal input portions via a pair of conductive portions provided on the top surface of the substrate and said pair of conductive portions are each formed of a metal that is a good electrical conductor.

3. An initiator according to claim 1, wherein the film of nickel-chrome alloy is adhered to said top surface of the substrate.

4. An initiator according to claim 2, wherein the film of nickel-chrome alloy is adhered to said top surface of the substrate.

5. An initiator according to claim 1, wherein said explosive charge is a compound having zirconium and an oxidizing agent as its main components.

* * * * *